US011933579B1

(12) United States Patent
Achkar

(10) Patent No.: US 11,933,579 B1
(45) Date of Patent: Mar. 19, 2024

(54) WEAPON WITH AN INTEGRATED WINCH

(71) Applicant: Nibal Achkar, Biggar (CA)

(72) Inventor: Nibal Achkar, Biggar (CA)

( * ) Notice: Subject to any disclaimer, the term of this patent is extended or adjusted under 35 U.S.C. 154(b) by 0 days.

(21) Appl. No.: 17/984,544

(22) Filed: Nov. 10, 2022

(51) Int. Cl.
*F41B 5/14* (2006.01)
*F41C 7/00* (2006.01)

(52) U.S. Cl.
CPC ..... *F41B 5/148* (2013.01); *F41B 5/14* (2013.01); *F41C 7/00* (2013.01)

(58) Field of Classification Search
CPC ..... F41B 5/14; F41B 5/1488; F41C 27/00; F41C 7/00; F41C 33/00
See application file for complete search history.

(56) References Cited

U.S. PATENT DOCUMENTS 2,938,514 A * 5/1960 Berg ..... F41B 5/1488 124/25.7
4,726,348 A * 2/1988 Saunders ..... F41B 5/1488 124/24.1
5,388,877 A * 2/1995 Wenk ..... B66D 1/04 294/82.11
5,609,147 A * 3/1997 Withorn, Jr. ..... F41B 5/1488 242/129.7
9,146,073 B1 * 9/2015 Roy ..... F41B 5/1461
9,610,684 B1 * 4/2017 Easterling ..... B25J 1/02

* cited by examiner

*Primary Examiner* — John A Ricci
(74) *Attorney, Agent, or Firm* — Donald J. Ersler

(57) ABSTRACT

Weapon with an integrated winch (integrated winch) includes a reel, a tightening bolt and a line. One end of the line is attached to the reel and the other end of the line is preferably terminated with a line loop. A line O-ring is retained by the line loop. The tightening bolt may be inserted through a riser hole, threaded into a riser or threaded into stabilizer or the like. The tightening bolt is inserted through an axle hole in the reel. Tightening a head of the tightening bolt head prevents the reel from rotating. The line is prevented from unraveling by securing the line O-ring to the reel. A second embodiment of the integrated winch preferably includes the reel, a bracket, a reel axle, a riser bolt and two thumb nuts. The reel is rotatably retained by the bracket and the bracket is retained in a riser.

18 Claims, 12 Drawing Sheets

WEAPON WITH AN INTEGRATED WINCH

BACKGROUND OF THE INVENTION

1. Field of the Invention

The present invention relates generally to hunting and more specifically to a weapon with an integrated winch, which allows the weapon to be raised to a tree stand or lowered to the ground from the tree stand.

2. Discussion of the Prior Art

Many hunters use tree stands to hunt for deer and other game animals. Safely climbing a tree stand requires the use of two hands. It is possible to climb a tree stand with one hand and hold the weapon with the other hand. However, it is better to use two hands for safety, especially for older hunters.

Accordingly, there is clearly felt need in the art for a weapon with an integrated winch, which allows the weapon to be raised to a tree stand or lowered to the ground from a tree stand without the risk of falling from the tree stand.

SUMMARY OF THE INVENTION

The present invention provides a weapon with an integrated winch, which allows the use of two hands to climb or descend from a tree stand. The weapon with an integrated winch (integrated winch) preferably includes a reel, a tightening bolt and a line. The reel preferably includes a first end plate, a winding member and a second end plate. The first end plate extends from a first end of the winding member and the second end plate extends from a second end of the winding member. At least one of the first or second end plates preferably include a peripheral O-ring groove for retaining an O-ring. The tightening bolt includes a bolt head and a shaft member. The shaft member extends from a bottom of the bolt head. The bolt head includes an outer perimeter with a grip surface. An end of the shaft member includes a male thread. One end of the line is attached to the reel and the other end of the line is preferably terminated with a line loop and a line O-ring. The line loop retains the line O-ring. However, the O-ring may only be needed in certain applications. The line O-ring is sized to be received by the end plate peripheral O-ring groove. The line loop is used by itself for securement to a thumb nut or any other structure, such as a line loop retainer. A female thread is preferably formed in a riser of the archery bow to threadably receive shaft member. However, the shaft tightening bolt may be threaded into a balancer or a stabilizer. Finally, the integrated firearm winch may be secured to a firearm for lifting and lower the firearm into a tree stand. The tightening bolt is inserted through an axle hole in the reel. Tightening the bolt head prevents the reel from rotating. The line is prevented from unraveling by securing the line O-ring in the peripheral O-ring groove.

A second embodiment of the integrated winch preferably includes the reel, a bracket, a reel axle, an attachment bolt and two thumb nuts. The bracket includes an attachment boss extending from a bottom thereof on one end. A bolt opening is formed through the attachment boss and an axle hole is formed through an opposing end of the bracket. The attachment bolt is inserted through the bolt opening and tightened to secure the bracket to a weapon. However, the bracket may be integrated into a riser of a bow during manufacturing. Opposing ends of the reel axle are threaded to receive the two thumb nuts. A first thumb nut is secured to a first end of the reel axle with a locking fluid, a set-screw or any other suitable method to prevent rotation thereof relative to the reel axle. The reel axle is inserted through the axle hole in the attachment boss and through the axle hole in the reel. The second thumb nut is threaded on to a second threaded end of the reel. The second thumb nut is used to lock and unlock rotation of the reel. A cranking pole preferably extends from an outer end plate of the reel. The O-ring loop of the line may be retained on the first or second thumb nuts. An alternative embodiment of the bracket includes a line guide. The line guide extends perpendicular from an opposing end of the bracket. The line guide includes a line hole formed through a middle of the line guide. The line is inserted through the line hole. The reel may be positioned inside a cavity in a riser of an archery bow or outside an outer perimeter of a riser. The reel may be retained in a stock of a firearm or weapon. The riser or stock is considered a base portion.

Accordingly, it is an object of the present invention to provide an integrated bow winch, which allows the archery bow or crossbow to be raised to a tree stand or lowered to the ground from the tree stand without the risk of falling from the tree stand.

Finally, it is another object of the present invention to provide an integrated winch, which allows a firearm to be raised to a tree stand or lowered to the ground from the tree stand without the risk of falling from the tree stand.

These and additional objects, advantages, features and benefits of the present invention will become apparent from the following specification.

DETAILED DESCRIPTION OF THE PREFERRED EMBODIMENTS

Figure 1:
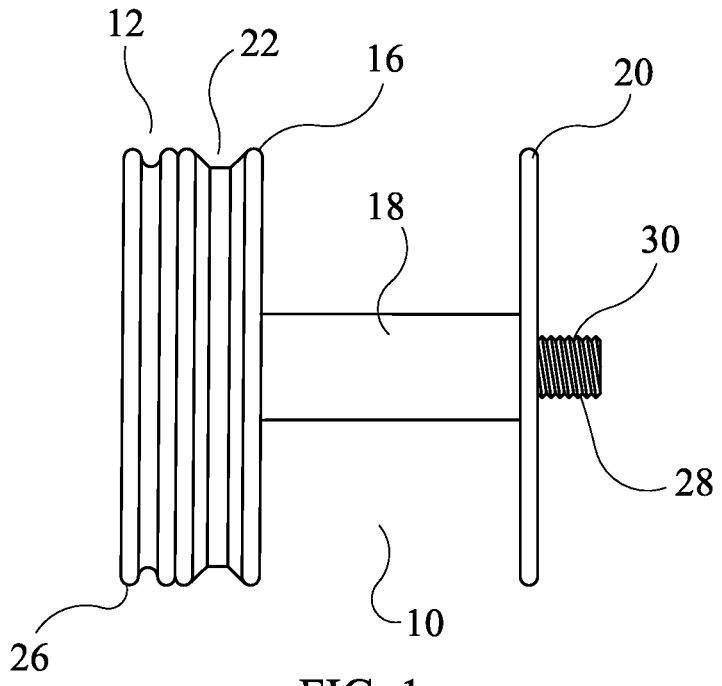
FIG. 1 is a top view of an integrated winch without a line on a reel in accordance with the present invention.
Figure 3:
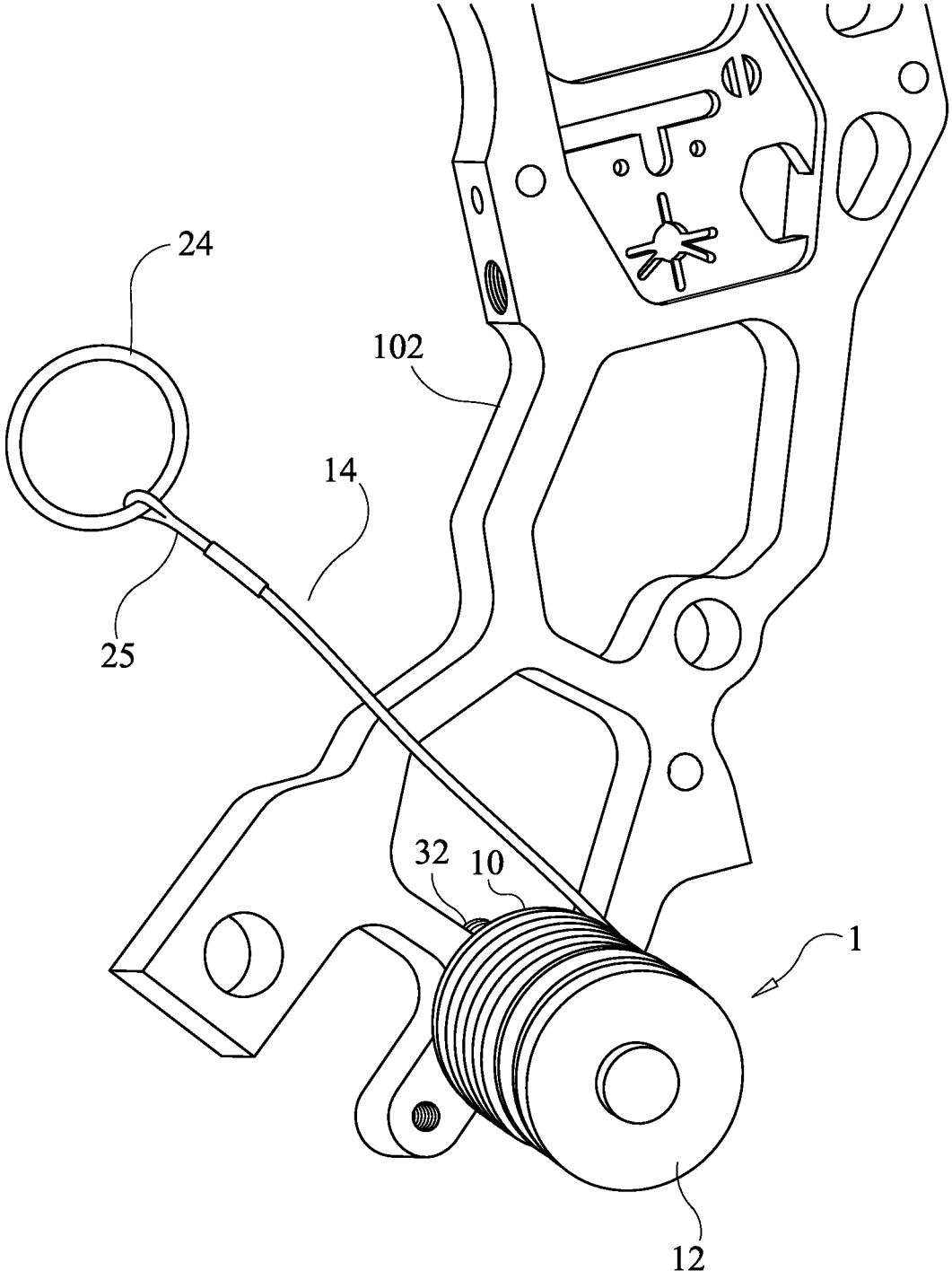
FIG. 3 is an end perspective view of an integrated winch retained on a riser of an archery bow in accordance with the present invention.

With reference now to the drawings, and particularly to FIGS. 1 and 3, there is shown a top view of an integrated bow winch 1. The integrated winch 1 preferably includes a reel 10, a tightening bolt 12 and a line 14. The reel 10 preferably includes a first end plate 16, a winding member 18 and a second end plate 20. The first end plate 16 extends from a first end of the winding member 18 and the second end plate extends 20 from a second end of the winding member 18. At least one of the first or second end plates 16, 20 preferably include a peripheral O-ring groove 22 for retaining an O-ring 24 extending from a line loop 25 of the line 14. The tightening bolt 12 includes a bolt head 26 and a shaft member 28. The shaft member 28 extends from a bottom of the bolt head 26. The bolt head 26 includes an outer perimeter with a grip surface, such as rubber or knurling. An end of the shaft member includes a male thread 30. One end of the line 14 is attached to the winding member 18 and the other end of the line 14 is preferably terminated with the line loop 25. The line O-ring 24 is sized to be received by the end plate peripheral O-ring groove 22.

Figure 4:
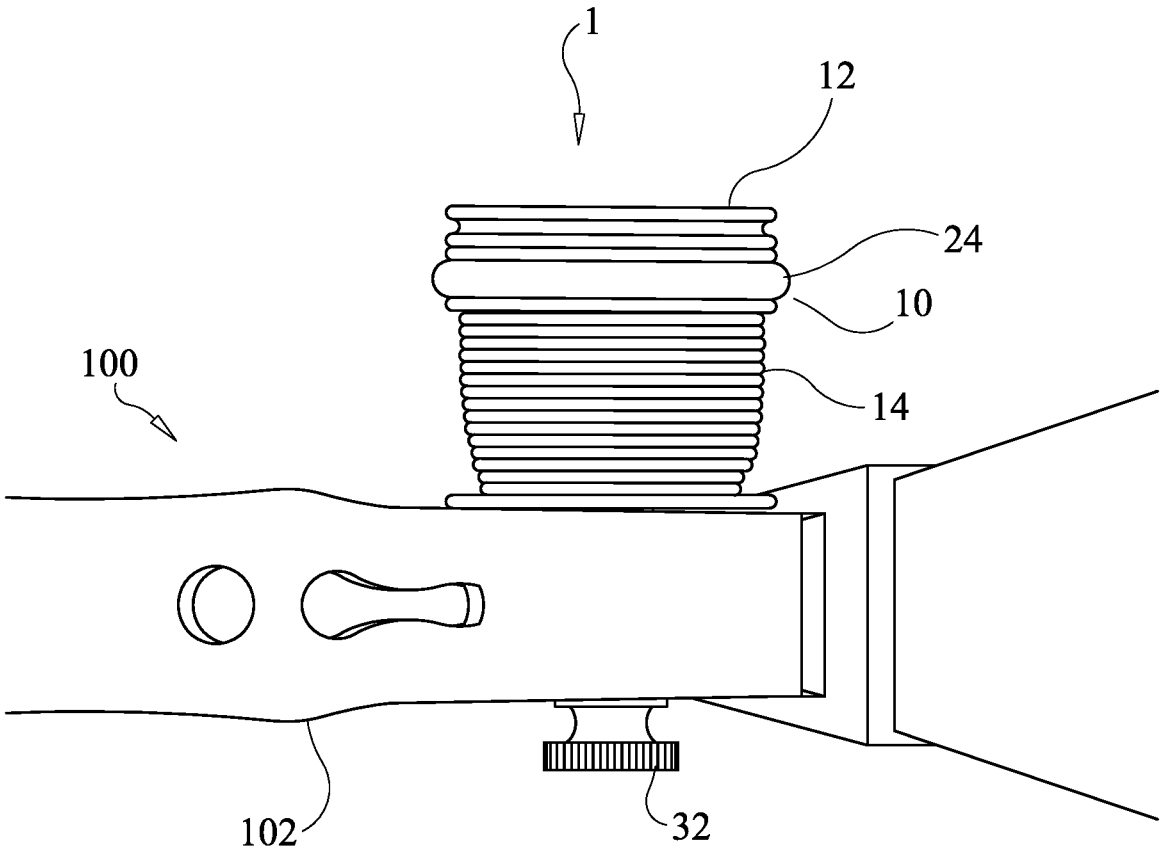
FIG. 4 is a top perspective view of an integrated winch retained on a riser of an archery bow with a tightening bolt extending through the riser in accordance with the present invention.
Figure 5:
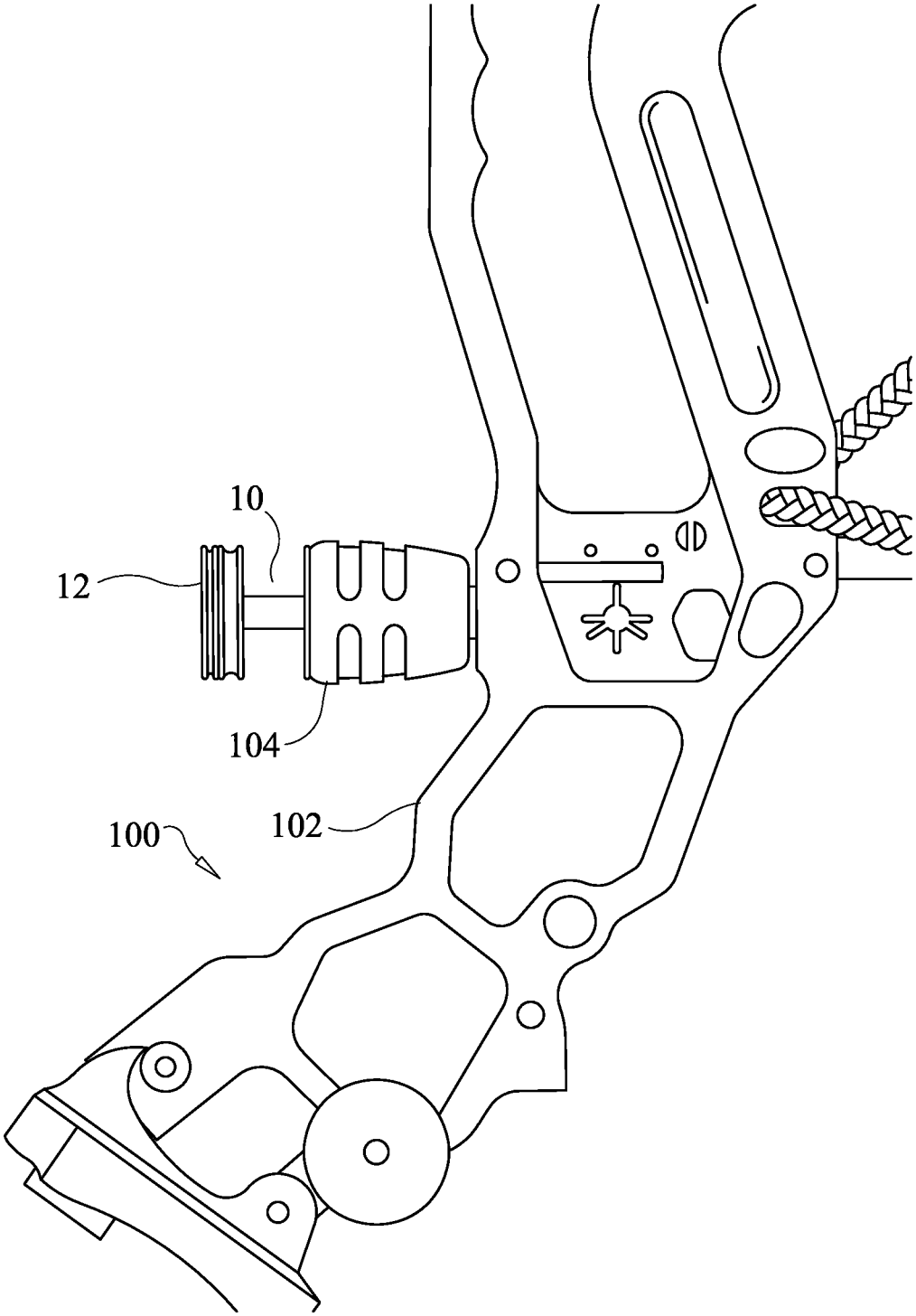
FIG. 5 is a top perspective view of an integrated winch without a line retained on a stabilizer extending from a riser of an archery bow in accordance with the present invention.
Figure 6:
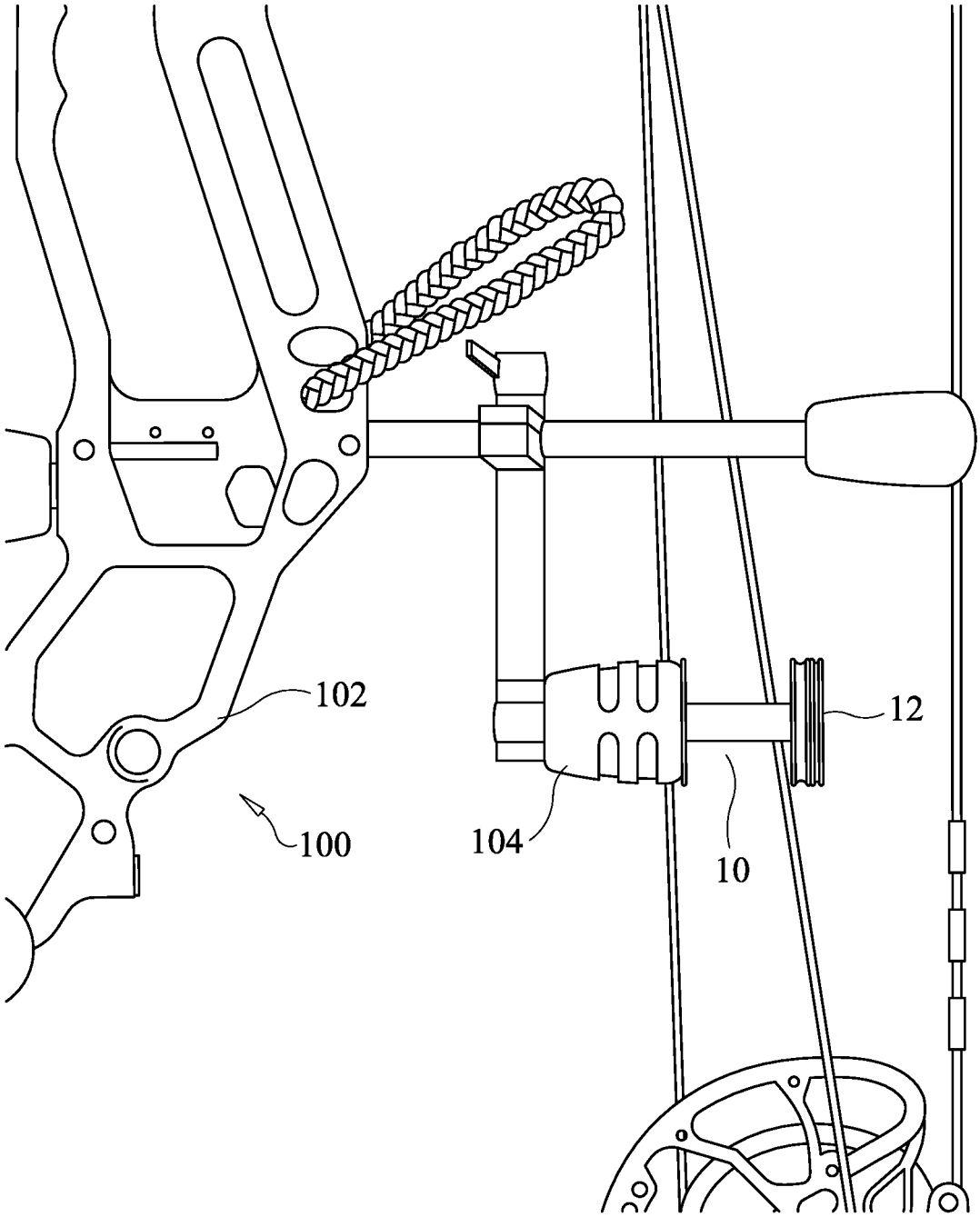
FIG. 6 is a top perspective view of an integrated winch without a line retained on a compound stabilizer extending from a riser of an archery bow in accordance with the present invention.
Figure 7:
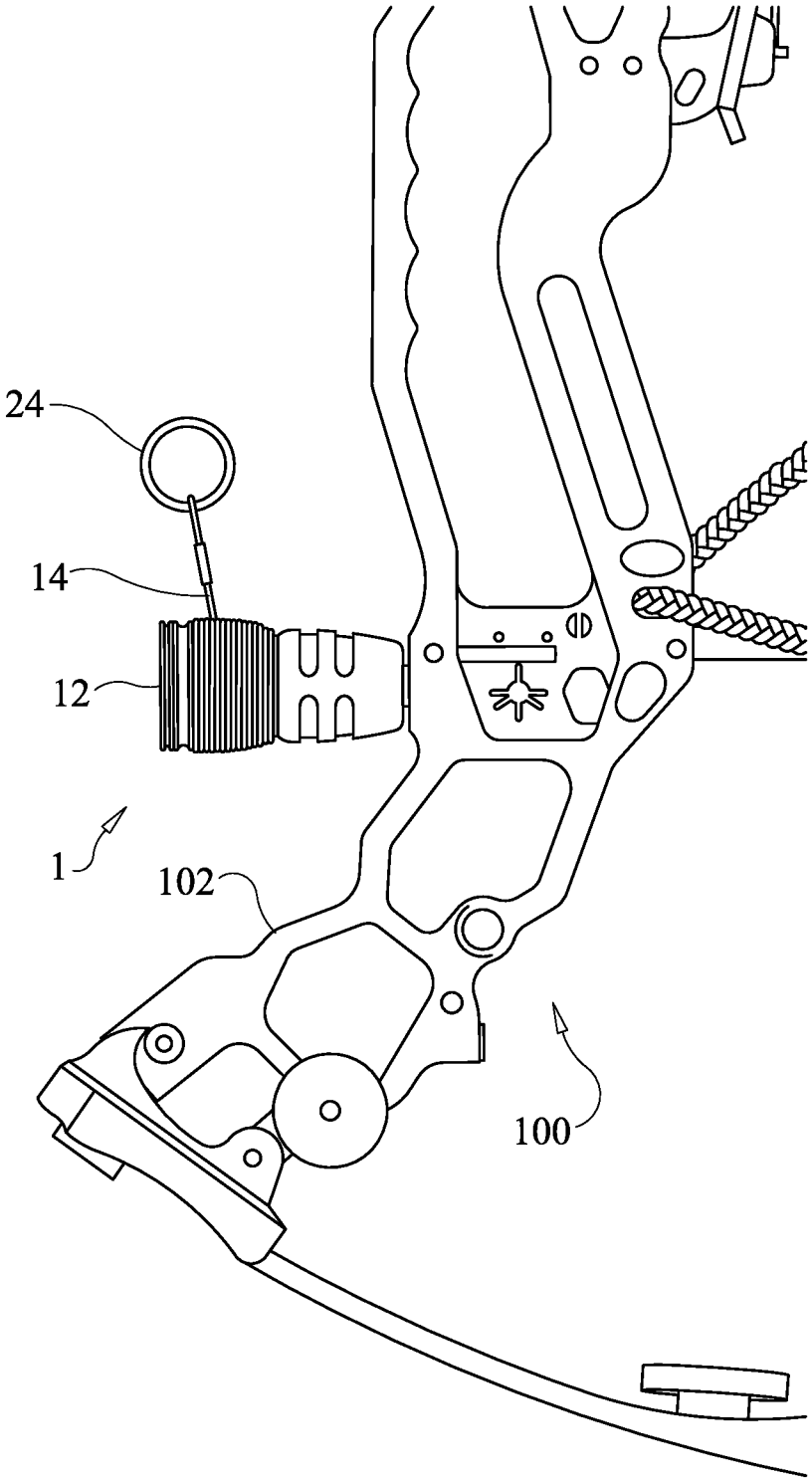
FIG. 7 is a top perspective view of an integrated winch retained on a stabilizer extending from a riser of an archery bow in accordance with the present invention.
Figure 8:
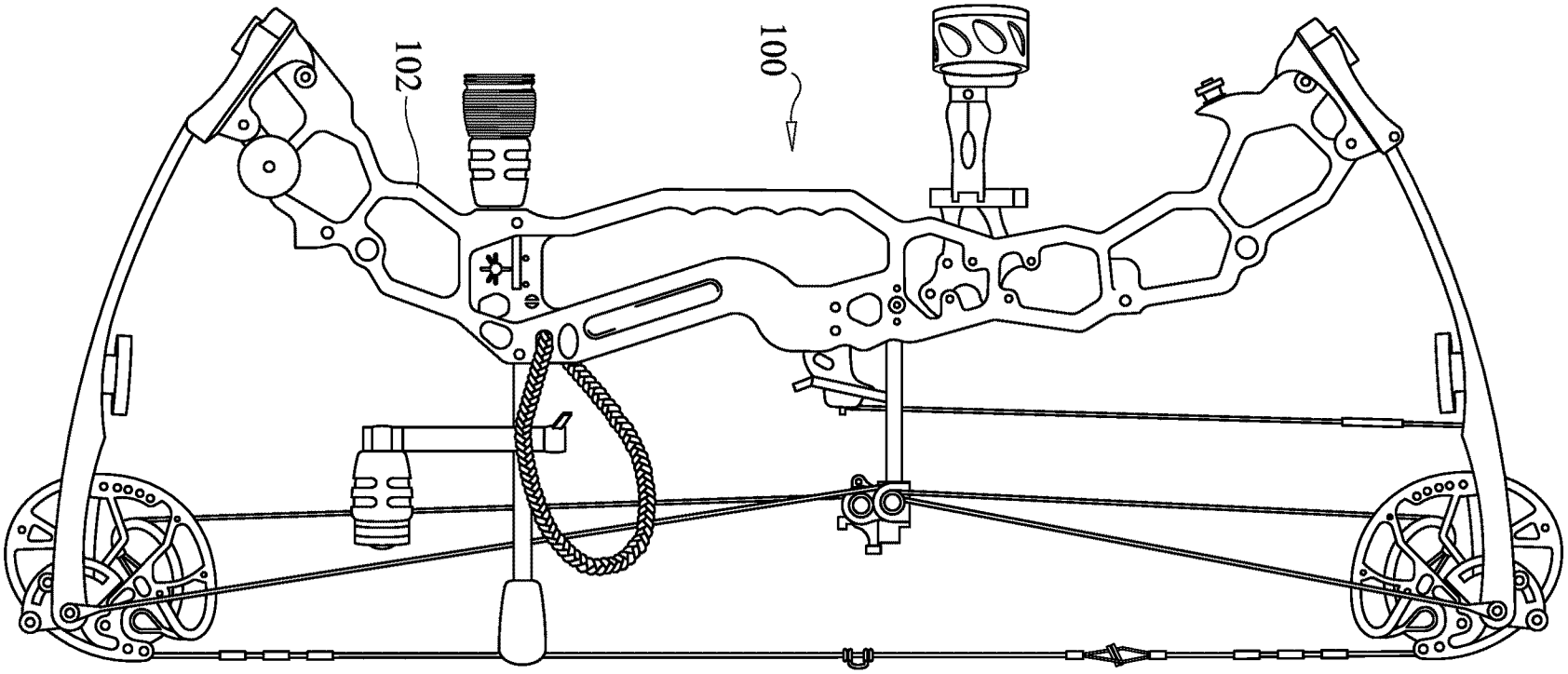
FIG. 8 is a top perspective view of an archery bow with an integrated winch retained on a stabilizer extending from a riser of an archery bow in accordance with the present invention.
Figure 9:
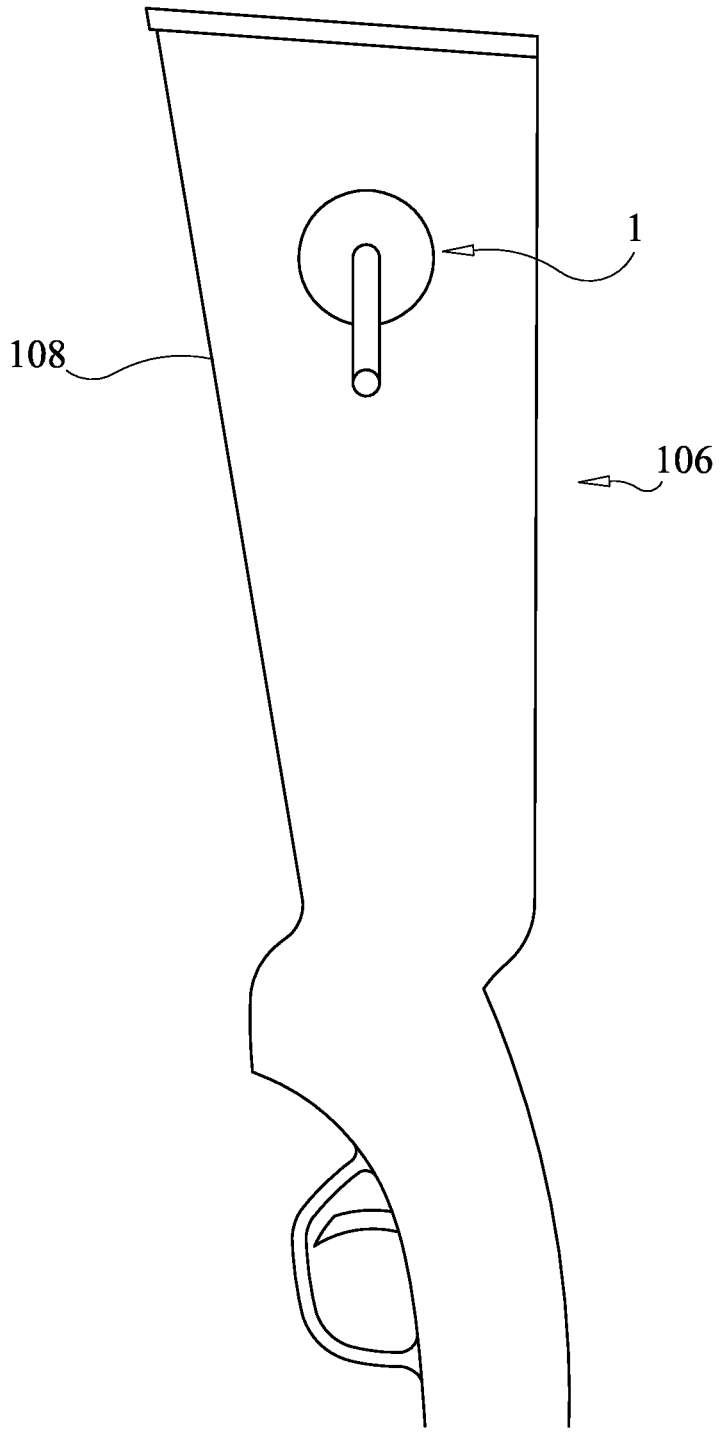
FIG. 9 is a side view of a firearm with an integrated winch retained in a side of a stock of the firearm in accordance with the present invention.

With reference to FIGS. 3-4, the shaft member 28 is inserted through a hole in a riser 102 of an archery bow 100. The tightening bolt 12 is retained in the hole with a thumb nut 32. However, a female thread may be formed in the riser 102 to threadably receive the shaft member 28. With reference to FIGS. 5, 7, 8, tightening bolt 12 is threaded into an archery accessory, such as a stabilizer 104, which in turn is threaded into the riser 102. However, the stabilizer 104 may be indirectly retained in the riser 102. The tightening bolt 12 is inserted through an axle hole in the reel 10. Tightening the bolt head 26 prevents the reel 10 from rotating. The line 14 is prevented from unraveling by securing the line O-ring 24 in the peripheral O-ring groove 22. With reference to FIG. 9, the integrated winch 1 may be secured to a stock 108 of a firearm 106 for lifting and lower the firearm 106 from a tree stand.

Figure 2:
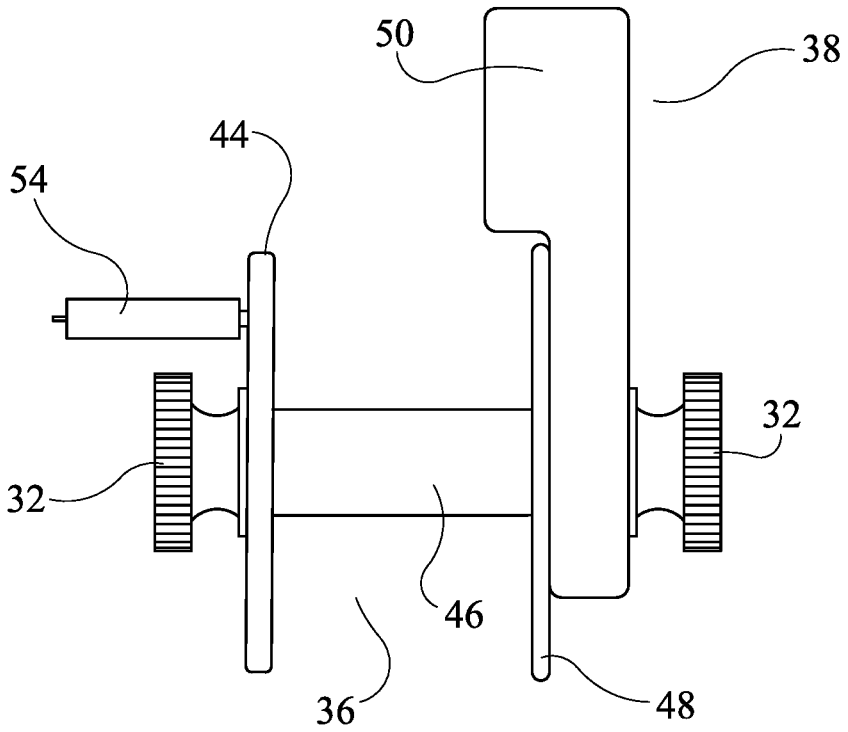
FIG. 2 is a top view of a second embodiment of an integrated winch without a line on a reel in accordance with the present invention.
Figure 10:
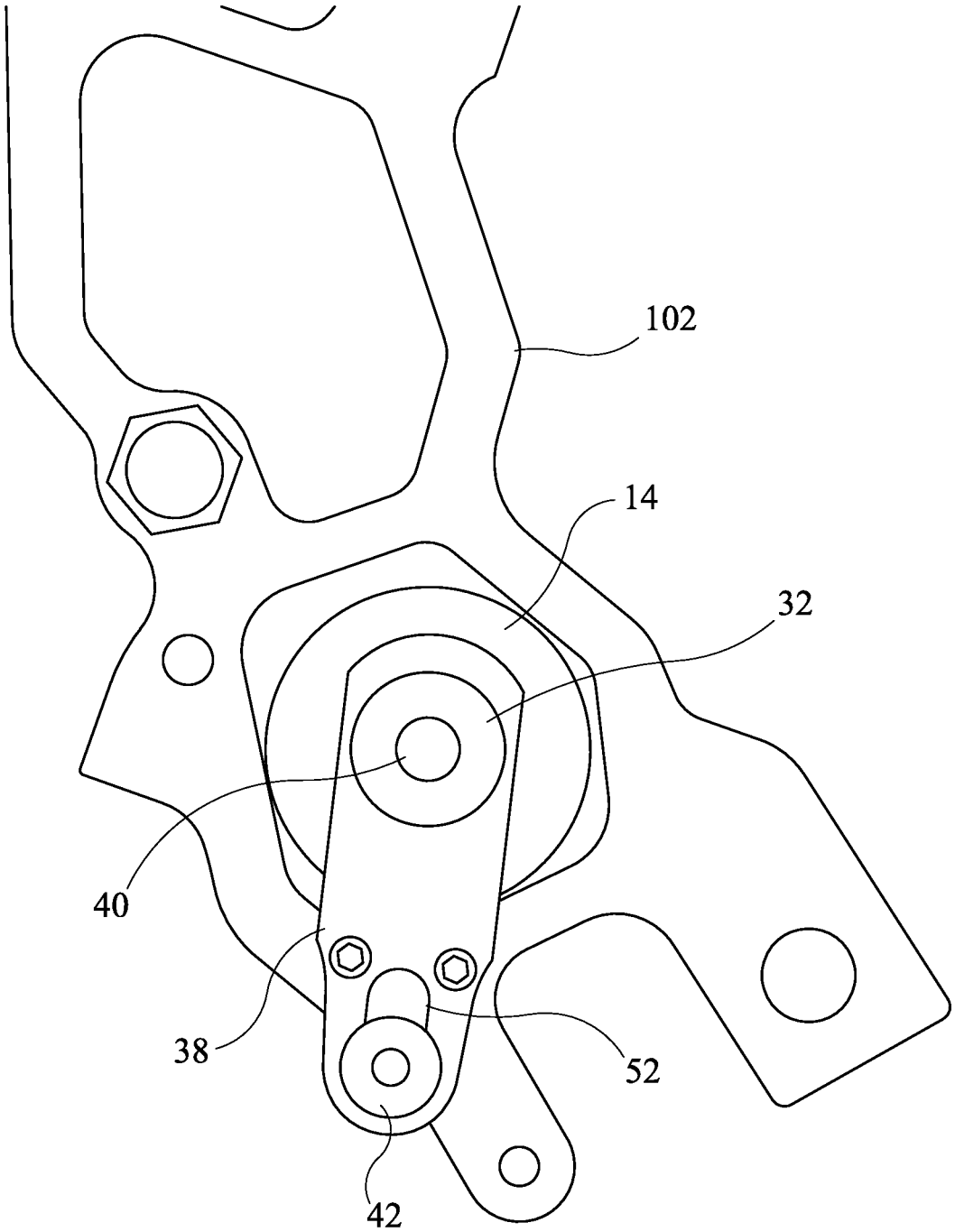
FIG. 10 is a bottom perspective view of a second embodiment of an integrated winch without a line attached to a riser and retained in a cavity in the riser in accordance with the present invention.
Figure 11:
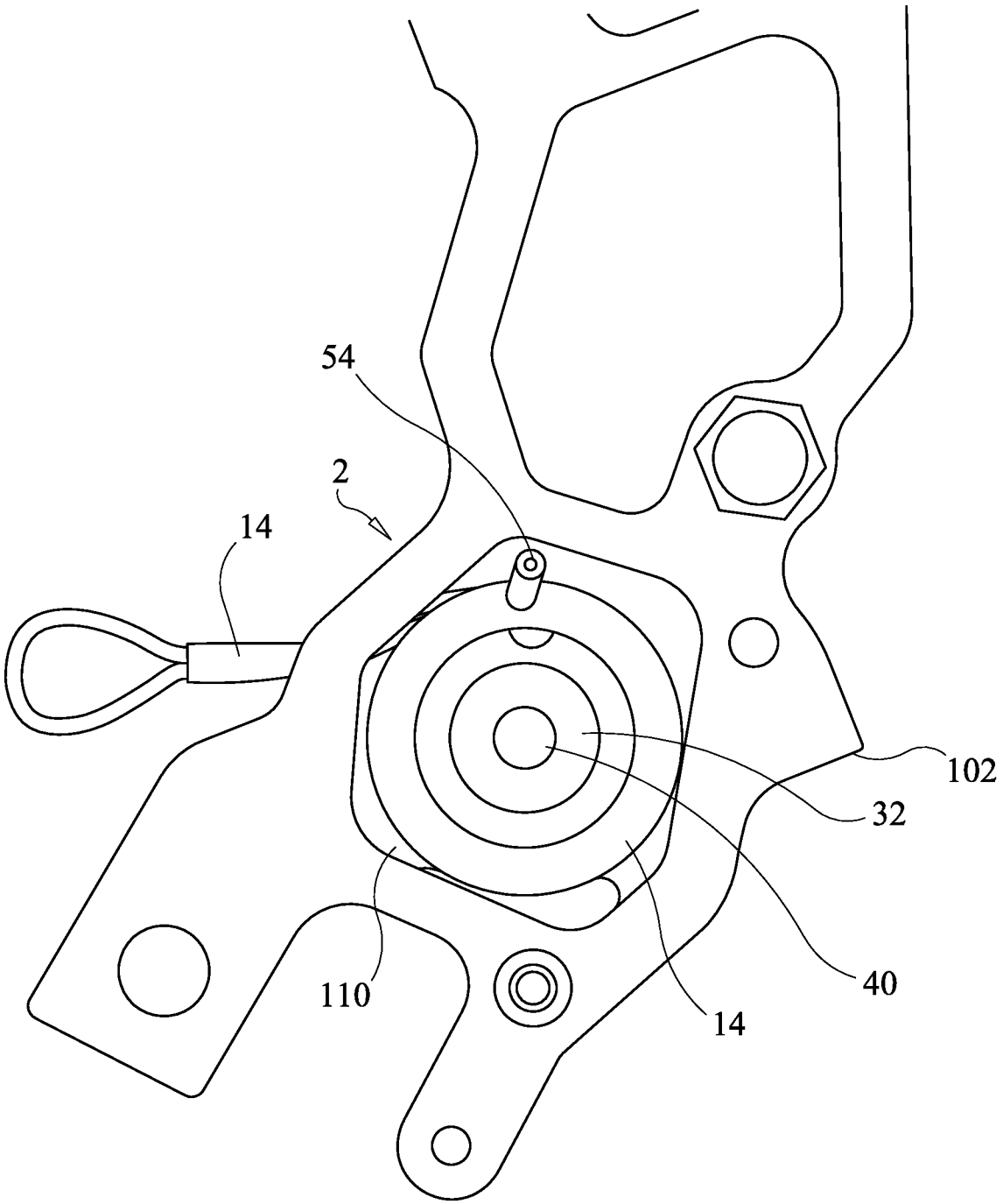
FIG. 11 is a top perspective view of a second embodiment of an integrated winch attached to a riser and retained in a cavity in the riser with a line protruding through a riser in accordance with the present invention.

With reference to FIGS. 2, 10, 11, an integrated winch 2 preferably includes a reel 36, a bracket 38, a reel axle 40, an attachment bolt 42 and two thumb nuts 32. The reel 36 preferably includes first end plate 44, a winding member 46 and a second end plate 48. The first end plate 44 extends from a first end of the winding member 46 and the second end plate extends 48 from a second end of the winding member 46. An axle hole is formed through the reel 36 to receive the reel axle 40. The bracket 38 includes an attachment boss 50 extending from a bottom thereof on one end. A bolt opening 52 is formed through the attachment boss 50 and an axle hole is formed through an opposing end of the bracket 38.

A riser female thread is formed in the riser 102. The attachment bolt 42 is inserted through the bolt opening 52 and tightened in the female riser thread to secure the bracket 38 to an archery bow riser 102. Opposing ends of the reel axle 40 are threaded to receive the two thumb nuts 32. A first thumb nut 32 is secured to a first thread on a first end of the reel axle 40 with a locking fluid, a set-screw or any other suitable method to prevent rotation thereof relative to the reel axle 40. The reel axle 40 is inserted through the axle hole in the attachment boss 50 and through the axle hole in the reel 36. The second thumb nut 32 is threaded on to a second threaded end of the reel axle 40. The second thumb nut 32 is used to lock or unlock rotation of the reel 36. A cranking pole 54 preferably extends from the first end plate 44 of the reel 36. The line loop 25 of the line 14 may be retained on the first or second thumb nuts 32.

Figure 12:
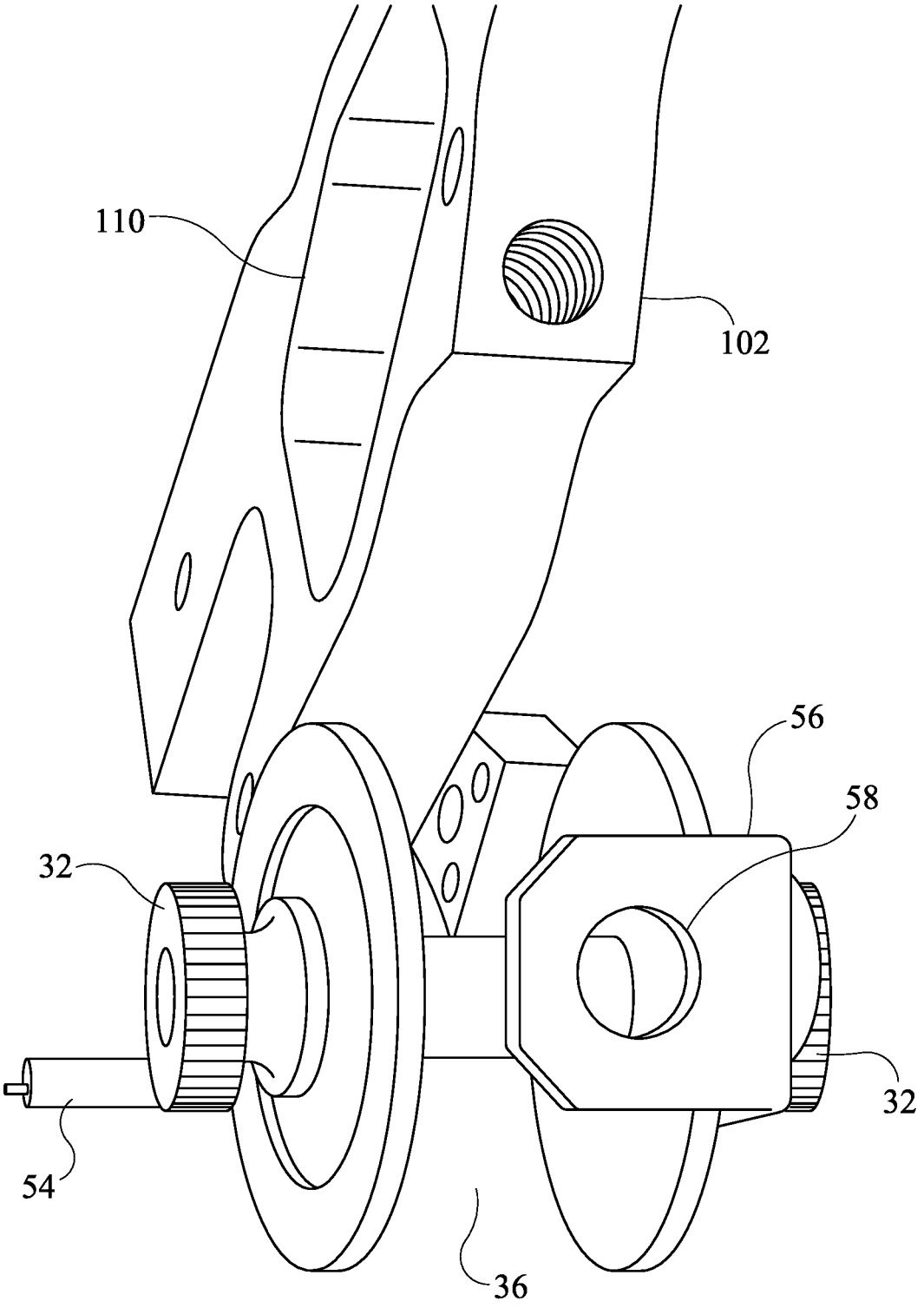
FIG. 12 is a perspective view of a second embodiment of an integrated winch without a string attached to a riser and with a guide plate extending from an opposing end of a bracket in the riser in accordance with the present invention.

With reference to FIG. 12, an alternative embodiment of the bracket 38 includes a line guide 56. The line guide 56 extends perpendicular from an opposing end of the bracket 38. The line guide 56 includes a line hole 58 formed through a middle of the line guide 56. The line 14 is inserted through the line hole 58. The reel 36 may be positioned inside a cavity 110 in the riser 102 or outside an outer perimeter of a riser 102.

The line 14 may be wound on to the reels 10, 36 by hand winding, crank winding, power winding or with spring recoil winding. The reel 10, 36 may include a friction clutch to have controlled unwinding of the line 14. The archery bow or firearm may be raised or lowered using a hand over hand method with the line 14 fully unreeled. A vertical bow is shown, but the integrated hoist 1, 2 may also be used on a crossbow. The integrated hoist may be used on any weapon, namely the archery bow or the firearm.

Figure 13:
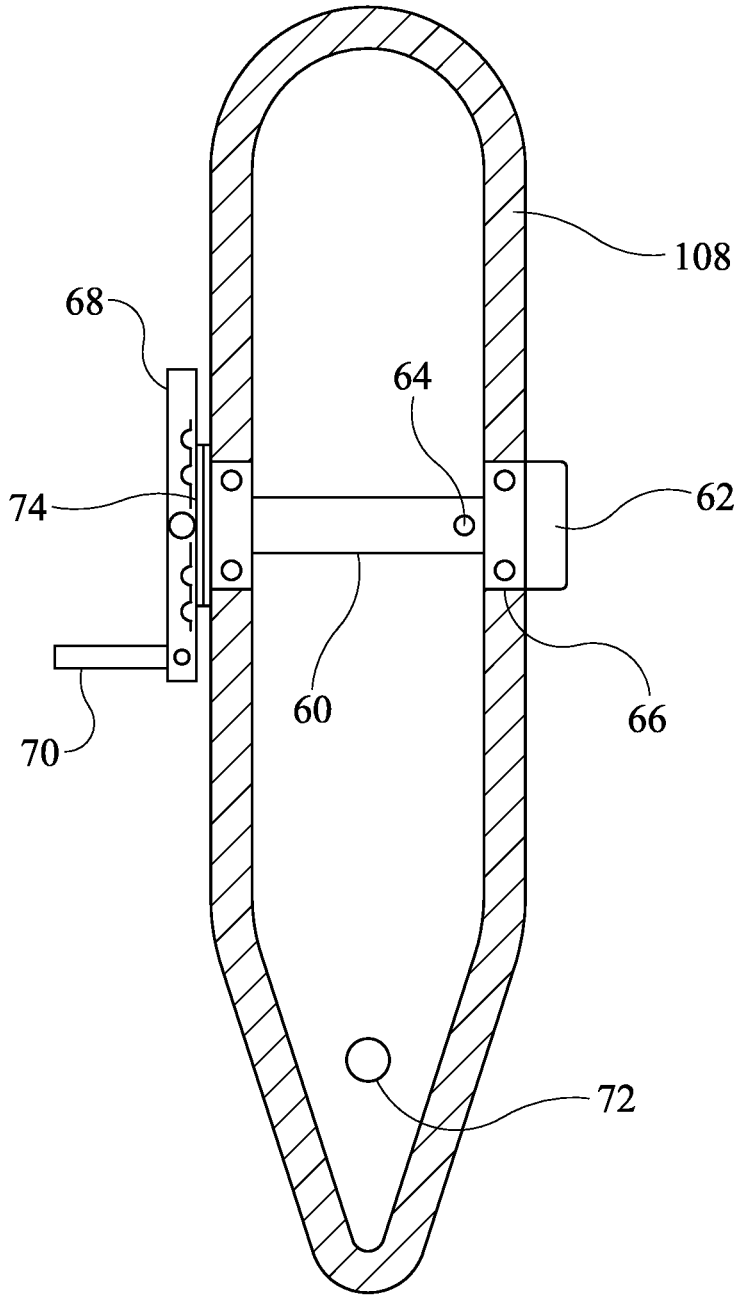
FIG. 13 is an end cross sectional view of a stock of a firearm with an axle rotatably retained therein in accordance with the present invention.

With reference to FIG. 13, an axle 60 is retain in a stock 108 of a firearm 106. The axle 60 includes a head 62 and a line hole 64 for securing the line 14. A pair of bearings 66 are preferably used to rotatably retained the axle 60. The axle 60 is terminated with a crank 68. The crank 68 preferably includes a folding handle 70. A line guide hole 72 is formed through an end of the stock 108. A friction plate 74 is preferably located between the crank and a side of the stock 108.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. An integrated winch for use with a weapon, comprising:

a reel having a first end plate, a winding member and a second end plate, said first end plate extends from a first end of said winding member, said second end plate extends from a second end of said winding member, a bolt hole is formed through a length of said reel, an O-ring groove is formed in at least one of said first and second end plates;

a tightening bolt includes a bolt head and a shaft member, a thread is formed on an end of said shaft member, said shaft member is inserted through said bolt hole; and a line having one end attached to said winding member, said line is terminated with a line O-ring, said O-ring groove is sized to receive said line O-ring, wherein said tightening bolt is secured to a base portion of an archery bow or a firearm, said bolt head is finger tightened relative to the base portion to prevent rotation of said reel.

2. The integrated winch for use with a weapon of claim 1 wherein:

an outer perimeter of said bolt head includes a finger gripping surface.

3. The integrated winch for use with a weapon of claim 1 wherein:

said reel is rotated by one of hand winding, crank winding, power winding, power unwinding or spring recoil winding.

4. The integrated winch for use with a weapon of claim 1 wherein:

said integrated winch is retained on an archery accessory or as an integrated portion of the archery accessory, the archery accessory is retained on a riser of the archery bow.

5. The integrated winch for use with a weapon of claim 4 wherein:

the archery bow is one of a vertical bow or a crossbow.

6. The integrated winch for use with a weapon of claim 1 wherein:

the weapon is a firearm, said integrated winch is retained in a stock of the firearm.

7. The integrated winch for use with a weapon of claim 1 wherein:

said reel is prevented from rotation when said tightening bolt is tightened.

8. An integrated winch for use with a weapon, comprising:

a reel having a first end plate, a winding member and a second end plate, said first end plate extends from a first end of said winding member, said second end plate extends from a second end of said winding member, an axle hole is formed through a length of said reel;

at least one thumb nut;

an axle including a threaded first end, a threaded second end, said axle is inserted through said axle hole;

a bracket includes a weapon opening formed in one end, said threaded first end is retained in an opposing end of said bracket; and a line having one end attached to said winding member, wherein a bolt is inserted through said weapon opening to secure said bracket to a base portion of an archery bow or a firearm, finger tightening said at least one thumb screw to said threaded second end prevents rotation of said reel.

9. The integrated winch for use with a weapon of claim 8 wherein:

said line is terminated with a line loop, said line loop is secured to said at least one thumb nut, or a line loop retainer.

10. The integrated winch for use with a weapon of claim 8 wherein:

an outer perimeter of said at least one thumb nut includes a finger gripping surface.

11. The integrated winch for use with a weapon of claim 8 wherein:

said reel is rotated by one of hand winding, crank winding, power winding, power unwinding or spring recoil winding.

12. The integrated winch for use with a weapon of claim 8 wherein:

the archery bow is one of a vertical bow or a crossbow.

13. The integrated winch for use with a weapon of claim 8 wherein:

said integrated winch is retained in a stock of the firearm.

14. The integrated winch for use with a weapon of claim 8 wherein:

said integrated winch is retained in a cavity of a riser of the archery bow.

15. The integrated winch for use with a weapon of claim 8 wherein:

a line guide extends perpendicular from an opposing end of said bracket, said line guide includes a line hole formed through a middle of said line guide, said line is inserted through said line hole.

16. The integrated winch for use with a weapon of claim 8, further comprising:

a friction clutch is retained on said reel for controlled winding and unwinding.

17. The integrated winch for use with a weapon of claim 8, wherein:

said bracket is integrated into said base portion.

18. An integrated winch for use with a weapon, comprising:

a base portion of the weapon includes a reel cavity, said reel cavity includes two opposing side walls;

an axle is inserted through said two opposing side walls;

a crank is retained on an end of said axle;

a friction clutch located between one of said two opposing side walls and said crank prevents free rotation of said axle; and a line having one end attached to said axle.

* * * * *